US006732730B1

(12) United States Patent
Lin

(10) Patent No.: US 6,732,730 B1
(45) Date of Patent: May 11, 2004

(54) ADJUSTABLE SMOKE INLET SET FOR KITCHEN VENTILATOR

(76) Inventor: Chun-Ying Lin, No. 41. Lane 320, Sec. 1, Sha-Tien Rd., Tatu County, Tai-Chung Hsien (TW)

( * ) Notice: Subject to any disclaimer, the term of this patent is extended or adjusted under 35 U.S.C. 154(b) by 0 days.

(21) Appl. No.: 10/377,460

(22) Filed: Feb. 28, 2003

(51) Int. Cl.[7] ..... F24C 15/20
(52) U.S. Cl. ..... 126/299 R; 126/299 D
(58) Field of Search ..... 126/299 R, 299 D; 454/49

(56) References Cited

U.S. PATENT DOCUMENTS 3,757,751 A * 9/1973 Kitchin et al. ..... 123/566
4,446,849 A * 5/1984 McFarland ..... 126/299 R
6,216,686 B1 * 4/2001 Chiu ..... 126/299 R
6,604,520 B2 * 8/2003 Grimm et al. ..... 126/299 D
6,677,564 B1 * 1/2004 Sohn et al. ..... 219/757

* cited by examiner

*Primary Examiner*—Alfred Basichas
(74) *Attorney, Agent, or Firm*—Charles E. Baxley

(57) ABSTRACT

An adjustable smoke inlet set for kitchen ventilator comprising an open and hollow shoulder tube connecting to both sides of the air duct; an inclined tube is on the bottom of the shoulder tube; an inlet base in vertical tube shape with top links to the bottom the inclined tube and the bottom links to the filter set; several sealing structures are installed on the conjunction areas of the shoulder tube, the inclined tube and the inlet base; such scheme can fit different kitchen ventilators with different sizes and angles.

19 Claims, 8 Drawing Sheets

ADJUSTABLE SMOKE INLET SET FOR KITCHEN VENTILATOR

BACKGROUND OF THE INVENTION

I. Field of the Invention

This invention relates generally to an adjustable smoke inlet set for kitchen ventilator and, more specifically, to an adjustable smoke inlet set for kitchen ventilator that can adjust different assembly structures based on different types and sizes of various kitchen ventilator models.

II. Description of the Prior Art

Heretofore, it is known that the smoke inlet structure of a kitchen ventilator (as shown in FIG. 1) is to have an air duct in center, an inclined inlet base each is on both sides of the air duct, the bottom of the inlet base connects to an inhale hole of the inhale plate. The smoke is exhausted from the inhale hole, passed through the inlet base and expelled from the air duct directly.

Different kitchen ventilators have different air ducts, inhale hole sizes and locations, they are not able to share the same inlet base, therefore every different kitchen ventilator must have a different tooling for the proper inlet base that increases the manufacturing cost and inventory difficulty. Most of the smoke expelling tubes of the kitchen ventilators are installed on wall, therefore the air dusts must be installed on the back of the kitchen ventilators, however the inhale holes must locate on the center of the inhale plate, therefore the inlet bases must stretch out from back, such makes most of the inlet bases cannot share the same tooling, even both sides of the inlet bases must have different tooling.

SUMMARY OF THE INVENTION

It is therefore a primary object of the invention to provide an adjustable smoke inlet set for kitchen ventilator to solve the difficulty of the inlet base fitting different air ducts of different kitchen ventilator models problem.

In order to achieve the objective set forth, an adjustable smoke inlet set for kitchen ventilator in accordance with the present invention comprises a body have a shell with an air duct inside, two air inlets with filter set are on the bottom of the shell; two inlet sets consist of:

- a shoulder tube each located on the both side of the air duct;
- an inclined tube is on the bottom of the shoulder tube;
- an inlet base connects to the bottom of the inclined tube, a filter set is installed on the bottom of the inlet base;
- several sealing structures are on the conjunction areas of the shoulder tube, the inclined tube and the inlet base.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
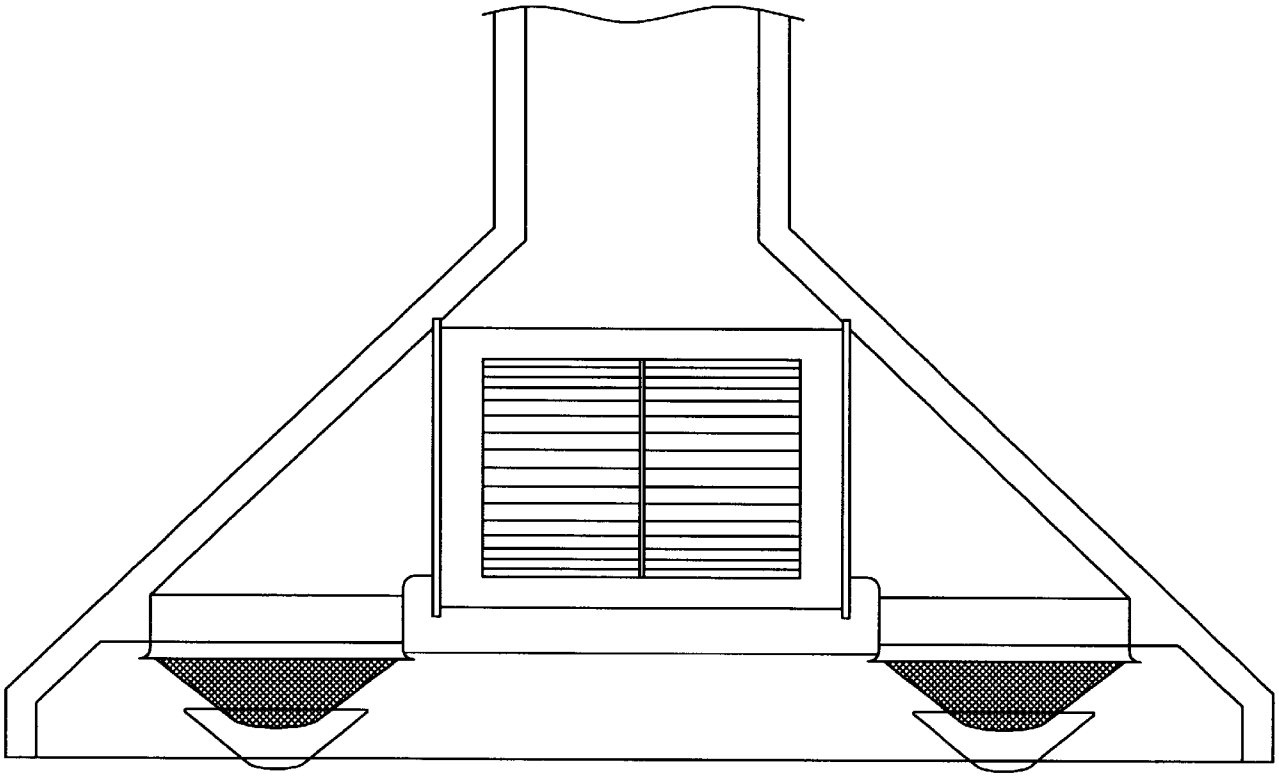
FIG. 1 PRIOR ART
FIG. 1 is a perspective view of the prior art.
Figure 2:
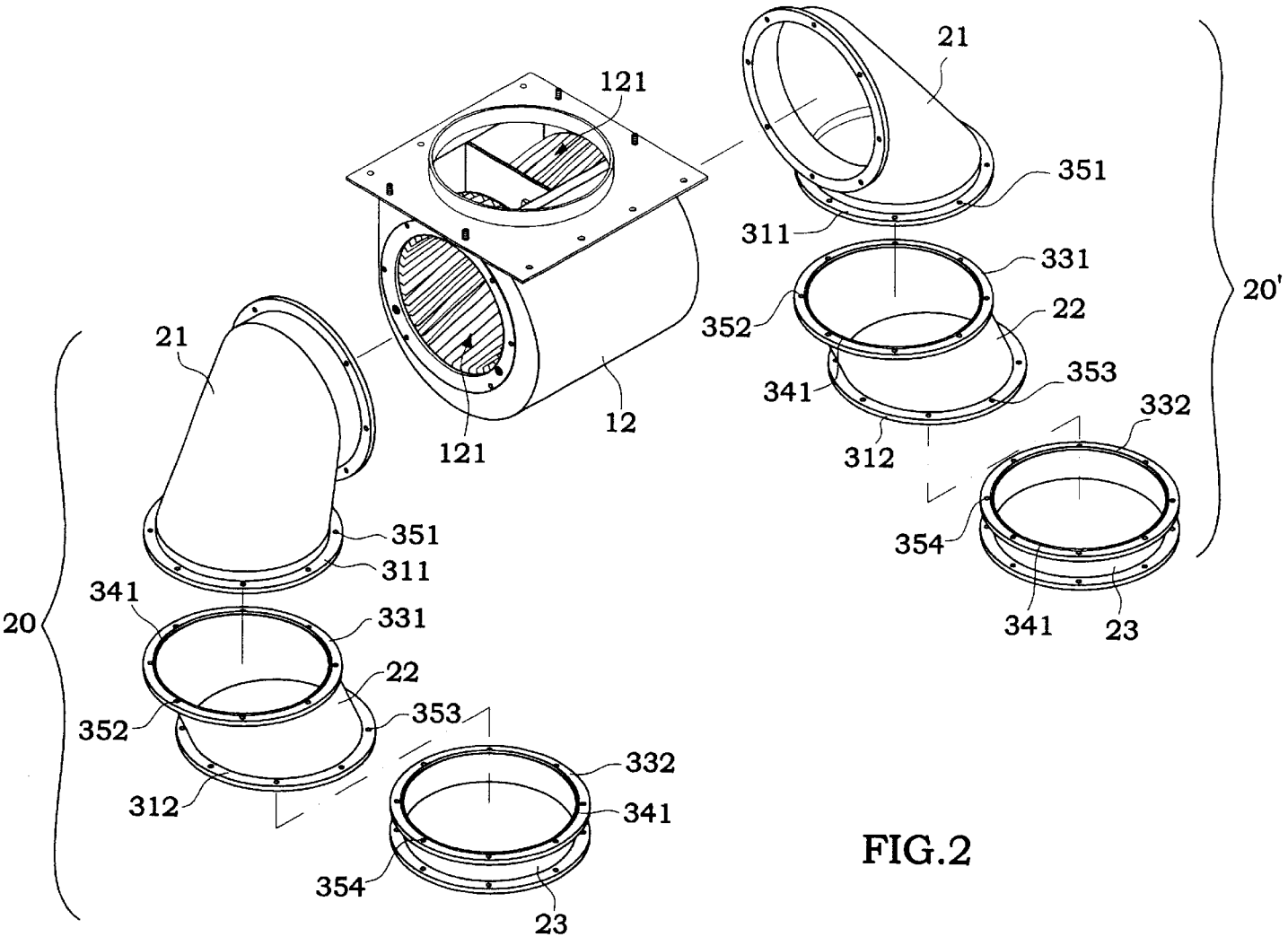
FIG. 2 is an assembly view of the present invention.
Figure 3:
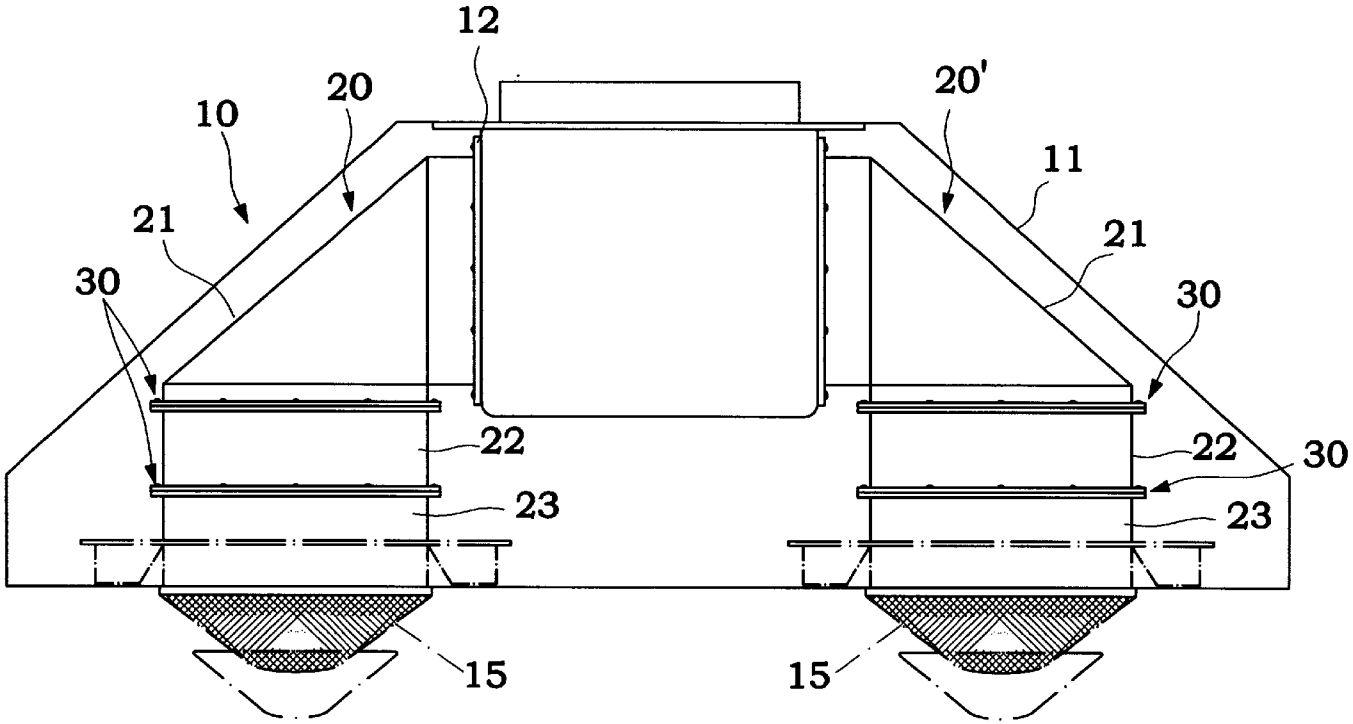
FIG. 3 is a cross-sectional view (I) of the present invention.
Figures 4A, 4B:
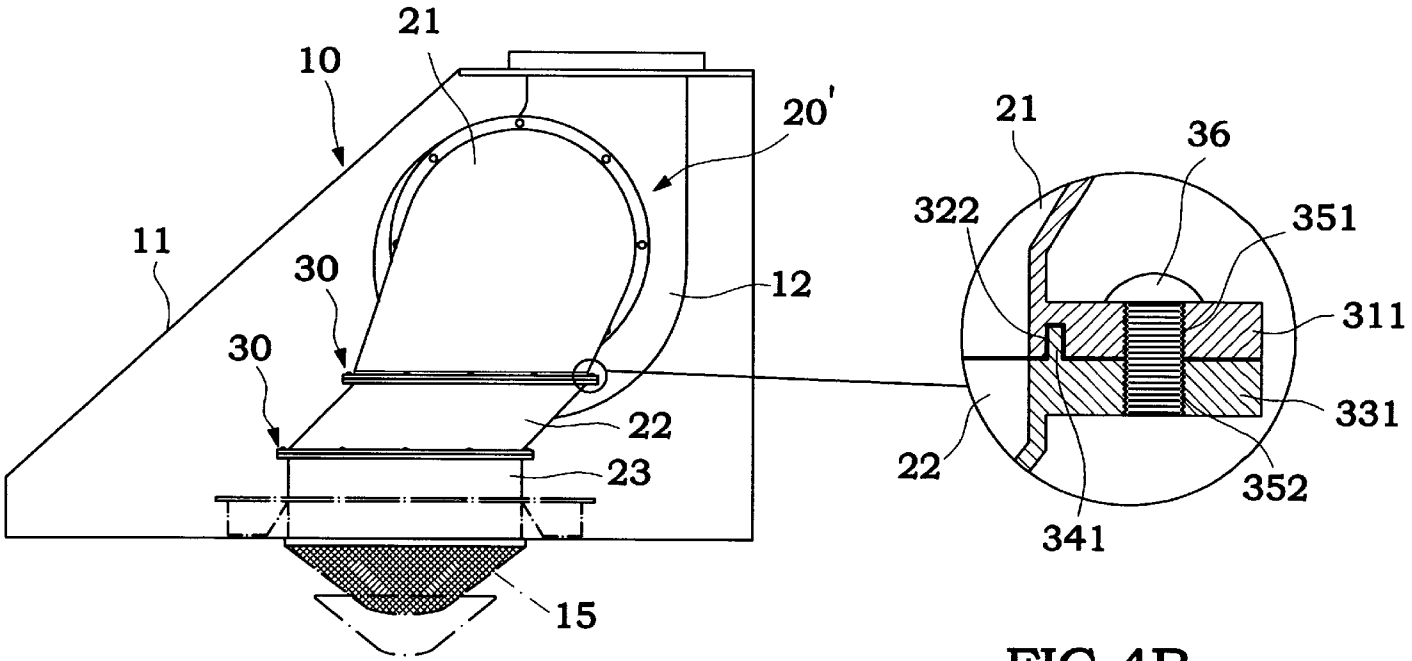
FIG. 4A is another cross-sectional view (II) of the present invention.
FIG. 4B is a cross-sectional view of the sealing structure of the present invention.

The accomplishment of the above-mentioned object of the present invention will become apparent from the following description and its accompanying drawings which disclose illustrative an embodiment of the present invention, and are as follows:

Referring to FIG. 2 to FIG. 4B, the present invention is composed of a body (10) consists of a shell (11) with an air duct (12) inside, two exhaust fan (121) brought by two motor (120) are inside the air duct (12), two air inlets with filter set (15) are on the bottom of the shell (11).

Two inlet set (20)(20') consist of a open and hollow shoulder tube (21) each are on the both side of the air duct (12), an inclined tube (22) is on the bottom of the shoulder tube (21), an inlet base (23) in vertical tube shape links to the bottom of the inclined tube (22); the filter set (15) is installed on the bottom of the inlet base (23).

Several sealing structure (30) are installed on the conjunction areas of the shoulder tube (21), the inclined tube (22) and the inlet base (23). An upper connecting brim (311)(312) each is on the bottom of the shoulder tube (21) and the inclined tube (22), a circular inserting slot (322) is near the inner ring of the upper connecting brim (311)(312); a corresponding lower connecting brim (331)(332) each is on the top of the inclined tube (22) and the inlet base (23), a circular inserting ring (341) is installed corresponding to the circular inserting slot (322); several screw hole (351)(352)(353)(354) are in equal distance on the upper connecting brim (311)(312) and the lower connecting brim (331)(332) to be fixed firmly with screw (36). When the upper connecting brim (311)(312) and the lower connecting brim (331)(332) are fixed firmly together, the circular inserting ring (341) are inserted into circular inserting slot (322) to prevent smoke and grease leaking from the junction.

Figure 5A:
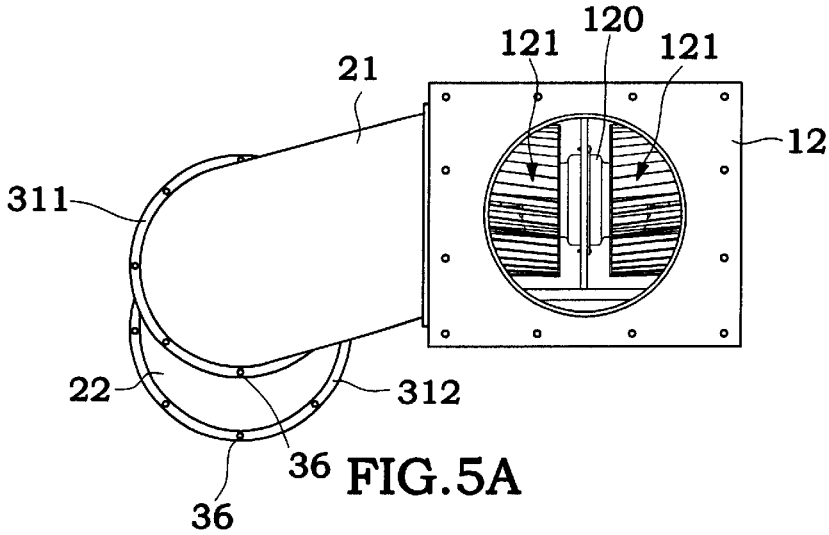
FIG. 5A is an installation view (I) of the present invention.
Figure 5B:
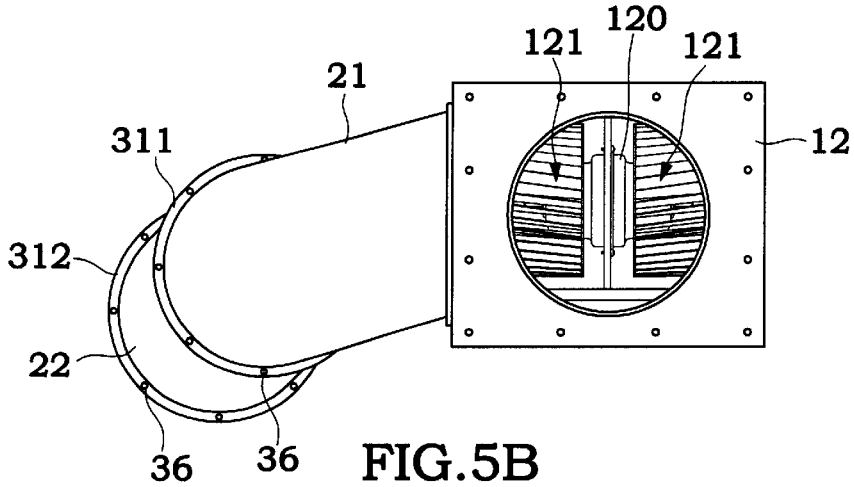
FIG. 5B is another installation view (II) of the present invention.
Figure 5C:
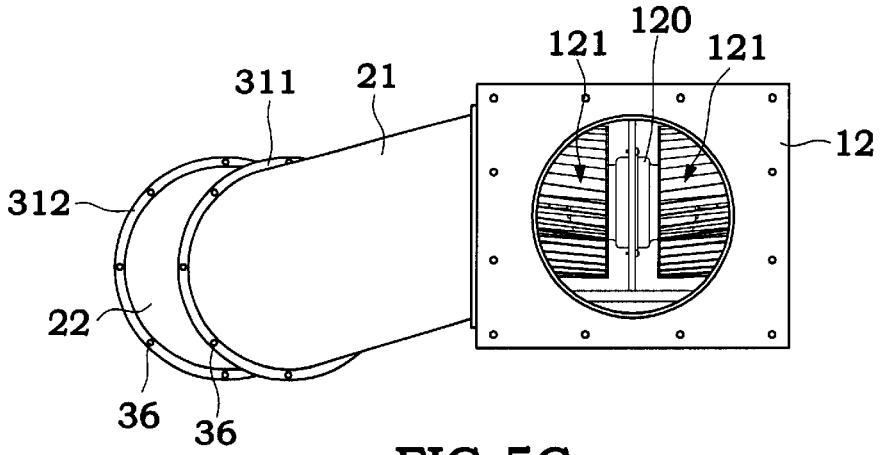
FIG. 5C is another installation view (III) of the present invention.

Referring to FIGS. 5A to 5C, several screw hole (351)(352) are in equal distance on the upper connecting brim (311) of the shoulder tube (21) and the lower connecting brim (331) of the inclined tube (22); users can adjust the direction of the inclined tube (22) to have the bottom of the inclined tube (22) toward front, side or inclined front, then adjust the angle and position of the shoulder tube (21) and the inclined tube (22) for the location of smoke inhale and the filter set (15), and have the screw hole (351)(352) of the upper connecting brim (311) and the lower connecting brim (331) align properly to fix them with screw (36), finally install the inlet base (23) and the filter set (15).

Users can adjust the direction and angle of the inlet set (20)(20') for different kinds of kitchen ventilators with different sizes. The inclined tube (22) is between the shoulder tube (21) and the filter set (15) to fit the different locations of the filter set (15) of different models. Even if the locations of the air duct (12) and the filter set (15) differ in distance and can not apply same inlet set (20)(20'), an inclined tube (22) with different height and different inclined angle can solve the problem easily, no need to make a different size of the inlet set (20)(20'), such scheme can reduce the cost dramatically. The two inclined tube (22) on both sides are same in shape, they can be made with one set of tooling to reduce the cost of tooling and manufacturing.

Figure 6:
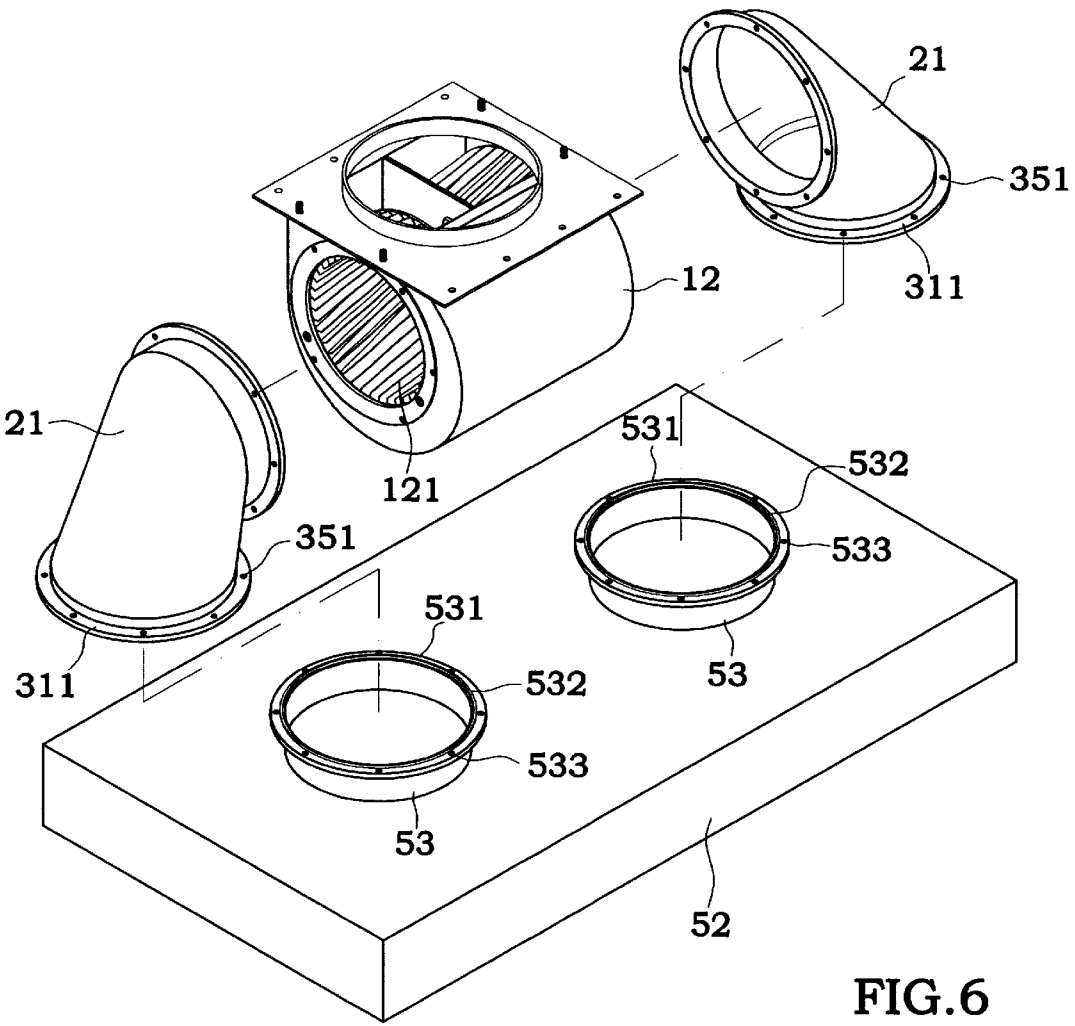
FIG. 6 is an assembly view of another application of the present invention.
Figures 7A, 7B:
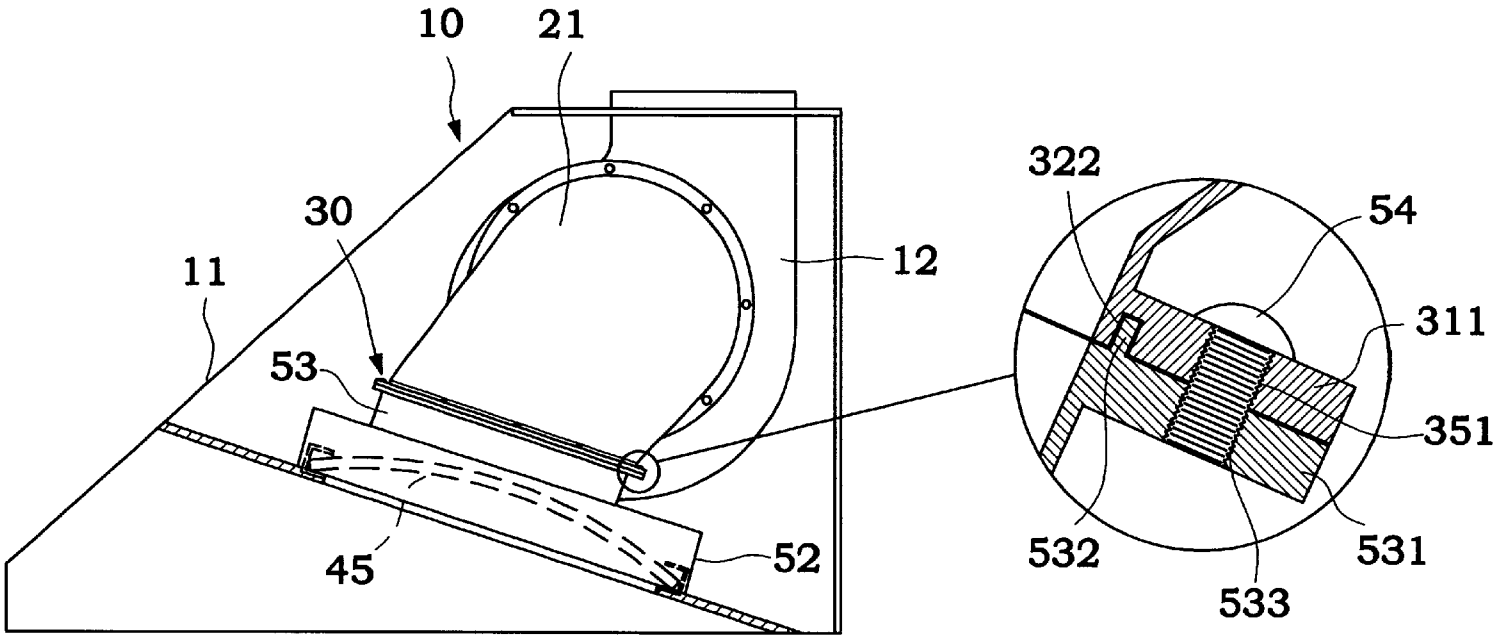
FIG. 7A is a cross-sectional view of another application of the present invention.
FIG. 7B is a cross-sectional view of the sealing structure of another application of the present invention.

Referring to FIG. 6 and FIG. 7, a different application of the present invention, a smoke inhale pan (52) is on the bottom of the shoulder tube (21), the smoke inhale pan (52) is in rectangular shape with open bottom, two eminent connecting circle (53) corresponding to the shoulder tube (21) are located on top of the smoke inhale pan (52); a lower connecting brim (531) with a the circular inserting ring (532) is on the top of the connecting circle (53), the circular inserting ring (532) is corresponding to the circular inserting slot (322) of the upper connecting brim (311) on the bottom of the shoulder tube (21); several screw hole (351)(533) are in equal distance on the upper connecting brim (311) and the lower connecting brim (531) for screw (54) to fix them up firmly; the bottom of the smoke inhale pan (52) is covered with a curve shape filter set (45).

Figure 8:
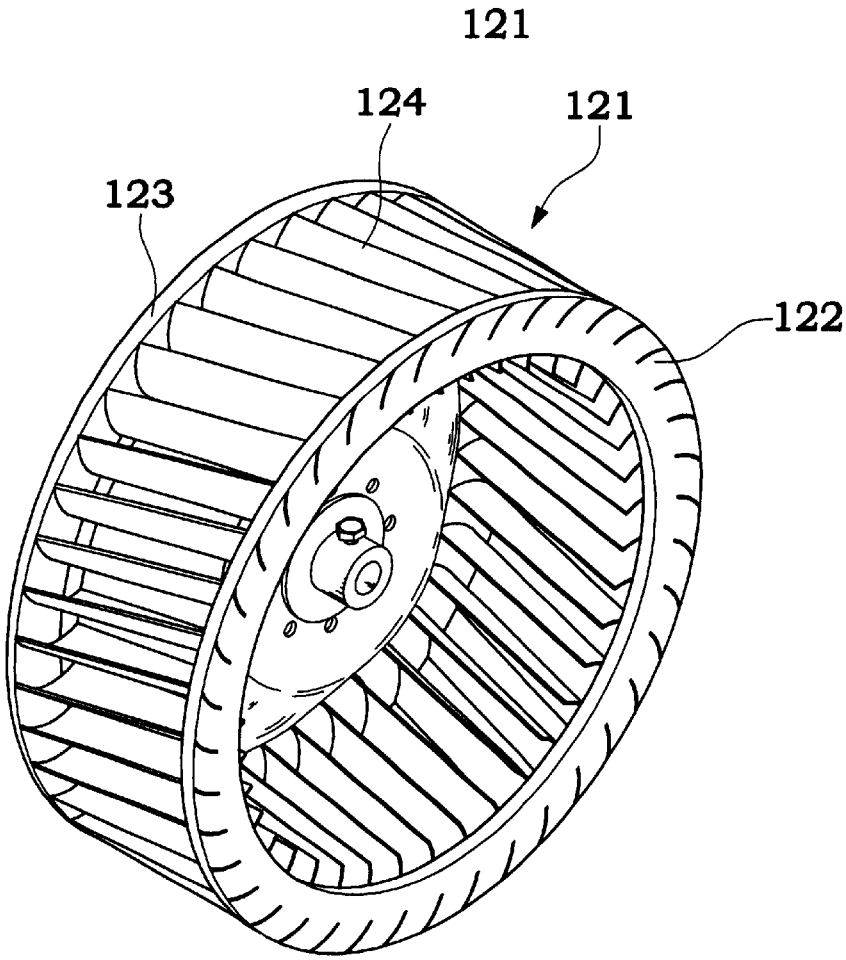
FIG. 8 is a perspective view of the exhaust fan of the present invention.

Referring to FIG. 8, each exhaust fan (121) consists of a front fan frame (122) and a rear fan frame (123), many fan blade (124) are installed between the two fan frame (122) (123) in parallel, the two ends of each fan blade (124) are fixed on the two fan frame (122)(123) in proper angle to increase the effect area of the fan blade (124), such scheme can increase the inhale result of the exhaust fan (121).

While a preferred embodiment of the invention has been shown and described in detail, it will be readily understood and appreciated that numerous omissions, changes and additions may be made without departing from the spirit and scope of the invention.

What is claimed is:

1. An adjustable smoke inlet set for kitchen ventilator comprising:

a body having a shell with an air duct inside, two air inlets with filter set being on the bottom of said shell, two exhaust fans brought by two motors located inside the air duct, two inlet sets consisting of a shoulder tube each located on the both sides of said air duct, an inclined tube located on the bottom of said shoulder tube, an inlet base linking to said inclined tube, said filter set is installed on the bottom of said inlet base.

2. The adjustable smoke inlet set for kitchen ventilator recited in claim 1, wherein said shoulder tube being in open and hollow shape and with turning angle and two open ends.

3. The adjustable smoke inlet set for kitchen ventilator recited in claim 1, wherein said inclined tube being in hollow inclined tube shape.

4. The adjustable smoke inlet set for kitchen ventilator recited in claim 1, wherein said inlet base being in hollow vertical tube shape.

5. The adjustable smoke inlet set for kitchen ventilator recited in claim 1, wherein several sealing structures installed on the conjunction areas of said shoulder tube, said inclined tube and said inlet base.

6. The adjustable smoke inlet set for kitchen ventilator recited in claim 5, wherein said sealing structure consisting of an upper connecting brim located on the bottom of said shoulder tube, a corresponding lower connecting brim located on the top of said inclined tube, several screw holes in equal distance on said upper connecting brim and said lower connecting brim for screws to fix them up firmly.

7. The adjustable smoke inlet set for kitchen ventilator recited in claim 6, wherein a circular inserting slot located near the inner ring of said upper connecting brim, a circular inserting ring corresponding to said circular inserting slot located on said lower circular connecting brim, when said upper connecting brim and said lower connecting brim fixed together, said circular inserting ring being inserted into said circular inserting slot.

8. The adjustable smoke inlet set for kitchen ventilator recited in claim 5, wherein said sealing structure consisting of an upper connecting brim located on the bottom of said inclined tube, a corresponding lower connecting brim located on the top of said inlet base, several screw holes in equal distance on said upper connecting brim and said lower connecting brim for screws to fix them up firmly.

9. The adjustable smoke inlet set for kitchen ventilator recited in claim 8, wherein a circular inserting slot located near the inner ring of said upper connecting brim, a circular inserting ring corresponding to said circular inserting slot located on said lower circular connecting brim, when said upper connecting brim and said lower connecting brim fixed together, said circular inserting ring being inserted into said circular inserting slot.

10. The adjustable smoke inlet set for kitchen ventilator recited in claim 1, wherein each of said exhaust fan consisting of a front fan frame and a rear fan frame, many fan blades are installed between said two fan frames in parallel, the two ends of each said fan blade are fixed on said two fan frames in proper angle to increase the effect area of said fan blade.

11. The adjustable smoke inlet set for kitchen ventilator comprising:

a body having of shell with an air duct inside, a exhaust motor located inside said air duct, two air inlets with filter set being on the bottom of said shell, two inlet sets consisting of a shoulder tube each located on the both side of said air duct, an inclined tube located on the bottom of said shoulder tube, an inlet base linking to said inclined tube, said filter set is installed on the bottom of said inlet base, several sealing structures installed on conjunction areas of said shoulder tube, said inclined tube and said inlet base.

12. The adjustable smoke inlet set for kitchen ventilator recited in claim 11, wherein shoulder tube being in open and hollow shape and with turning angle and two open ends.

13. The adjustable smoke inlet set for kitchen ventilator recited in claim 11, wherein said inclined tube being in hollow inclined tube shape.

14. The adjustable smoke inlet set for kitchen ventilator recited in claim 11, wherein said inlet base being in hollow vertical tube shape.

15. The adjustable smoke inlet set for kitchen ventilator recited in claim 11, wherein an upper connecting brim located on the bottom of said shoulder tube, a corresponding lower connecting brim located on the top of said inclined tube, several screw holes in equal distance on said upper connecting brim and said lower connecting brim for screws to fix them up.

16. The adjustable smoke inlet set for kitchen ventilator recited in claim 15, wherein a circular inserting slot located near the inner ring of said upper connecting brim, a circular inserting ring corresponding to said circular inserting slot located on said lower circular connecting brim, when said upper connecting brim and said lower connecting brim fixed together, said circular inserting ring being inserted into said circular inserting slot.

17. The adjustable smoke inlet set for kitchen ventilator recited in claim 11, wherein an upper connecting brim located on the bottom of said inclined tube, a corresponding lower connecting brim located on the top of said shoulder base, several screw holes in equal distance on said upper connecting brim and said lower connecting brim for screws to fix them up.

18. The adjustable smoke inlet set for kitchen ventilator recited in claim 17, wherein a circular inserting slot located near the inner ring of said upper connecting brim, a circular inserting ring corresponding to said circular inserting slot located on said lower circular connecting brim, when said upper connecting brim and said lower connecting brim fixed firmly together, said circular inserting ring being inserted into said circular inserting slot.

19. The adjustable smoke inlet set for kitchen ventilator recited in claim 11, wherein each of said exhaust fan consisting of a front fan frame and a rear fan frame, many fan blades are installed between said two fan frames in parallel, the two ends of each said fan blade are fixed on said two fan frames in proper angle to increase the effect area of said fan blade.

* * * * *